United States Patent [19]

Walker

[11] Patent Number: 4,467,741

[45] Date of Patent: Aug. 28, 1984

[54] SAIL ARRANGEMENTS

[75] Inventor: John G. Walker, Hamble, England

[73] Assignee: Walker Wingsail Systems Limited, London, England

[21] Appl. No.: 356,415

[22] Filed: Mar. 9, 1982

[30] Foreign Application Priority Data

| | | | |
|---|---|---|---|
| Mar. 19, 1981 | [GB] | United Kingdom | 8108575 |
| Aug. 4, 1981 | [GB] | United Kingdom | 8123831 |
| Aug. 25, 1981 | [GB] | United Kingdom | 8125958 |

[51] Int. Cl.[3] ..... B63H 9/04

[52] U.S. Cl. ..... 114/103; 114/39

[58] Field of Search ..... 114/39, 102, 103; 244/45 R, 215

[56] References Cited

U.S. PATENT DOCUMENTS 1,988,148 1/1935 Weymouth ..... 244/215

FOREIGN PATENT DOCUMENTS 1464877 11/1965 France ..... 114/103

2410599 10/1977 France ..... 114/103

*Primary Examiner*—Trygve M. Blix

*Assistant Examiner*—Patrick W. Young

*Attorney, Agent, or Firm*—Oblon, Fisher, Spivak, McClelland & Maier

[57] ABSTRACT

A wingsail has two rigid symmetrical aerofoil section sail sections (10, 12) which are mounted one downstream of the other, the trailing sail section (12) being freely pivotally mounted to the center line of the leading sail section (10) so that its leading edge just clears the trailing edge of leading sail section. A hinged symmetrical rigid flap (14) extends downwind from the trailing edge of the leading sail section (10), the flap being adapted to be moved to one side or the other in response to a swinging movement of the trailing sail section (12) relative to the leading sail section (10) so that the leeward surface of the flap (14) can form a more or less smooth extension of the leeward surface of the leading sail section (10), the spacing between the flap (14) and the trailing sail section (12) forming a convergent linear nozzle so as to assist in directing air over the leeward surface of the trailing sail section (12) and energize the local flow, prolong the extent of attachment of flow and enable the optimum thrust coefficient to be reached.

6 Claims, 8 Drawing Figures

SAIL ARRANGEMENTS

BACKGROUND OF THE INVENTION

1. Field of Invention

This invention concerns sail arrangements for boats and like craft and relates to a so-called wingsail, in particular an improvement to a wingsail rig which allows both port and starboard tacking and ahead/astern sailing.

2. Description of the Prior Art

A description of a basic wingsail rig is contained in an articles by John Walker entitled "Wingsails the Rig of the Future", published in Dinghy International December 1979. Wingsails have many advantages over ordinary sailing rigs in terms of controllability, efficiency and drive but by their nature cannot readily be turned "inside out" as happens when an ordinary main sail gybes or tacks.

SUMMARY OF THE INVENTION

It is an object of the present invention to provide a rigid wingsail rig having a high thrust and low drag which is capable of the reversal necessary for both port and starboard tacking and ahead and astern sailing.

According to the present invention, there is provided a wingsail having two rigid symmetrical aerofoil section sail sections which are mounted one downstream of the other, the trailing sail section being freely pivotally mounted to the center line of the leading said section, so that its leading edge just clears the trailing edge of the leading sail section, a hinged symmetrical rigid flap being provided which extends downwind from the trailing edge of the leading sail section, the flap being adapted to be moved to one side or the other in response to a swinging movement of the trailing sail section relative to the leading sail section so that the leeward surface of the flap can form a more or less smooth extension of the leeward surface of the leading sail section, the spacing between the flap and the trailing sail section forming a convergent linear nozzle so as to assist in directing air over the leeward surface of the trailing sail section and energize the local flow, prolong the extent of attachment of flow and enable the optimum thrust coefficient to be reached.

Typically the trailing edge of the flap is attached by a rope or lanyard to the leading edge of the trailing sail section, and the length of the rope is selected so as to produced the required angular position of the flap under appropriate wind conditions as the trailing sail section pivots relative to the leading sail section. Since the flap is freely pivoted to the leading sail section, its angle will then be a function of the angle of the trailing sail section with reference to the center line of the leading sail section, provided there is enough wind to pull the rope taut. Thus, movement of the trailing sail section relative to the leading sail section to an extreme angle suitable for, say, downwind work, will pull the flap to a position where the nozzle is in the optimum configuration for that point of sailing, while reducing the angle of the trailing sail section to a position more suitable for windward sailing will allow the flap to move proportionately away from the maximum deflection position. In this position the combined leeward surface of the leading sail section and flap may be slightly "reflexed", but the arrangement will still provide a suitable slot conformation.

Since the flap along the trailing edge of the leading sail section extends downwind beyond the leading edge of the trailing sail section in order to produce the optimum convergent slot conformation, it is not possible for the trailing sail section to swing fully to port or starboard relative to the leading sail section unless the flap moves out of the way. When changing direction, such as during tacking, it is important to be able to reverse the camber of the combined sail sections and produce a so-called mirror effect which in conventional soft rigs is achieved by the change of "belly" of the fabric sail. In the present invention, this is achieved by allowing the flap to pass through the gap between the trailing edge of the leading sail section and the leading edge of the trailing sail section.

In order to obtain the longest possible flap chord length, the point at which the flap passes through will be set to near maximum deflection of the trailing sail section relative to the leading sail section. This means that in windward work the trailing sail section must be deflected to its maximum deflection to release the flap and then returned to a deflection more suitable for windward sailing. However, the invention is not limited to such an arrangement, and there is no reason why the invention should not be applied to an arrangement in which the flap may pass through at minimum operating deflection, further deflection of the trailing sail section simply adjusting to reaching, downwind or other sailing conditions.

BRIEF DESCRIPTION OF THE DRAWING

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
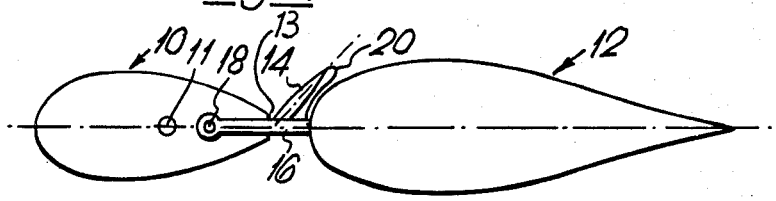
FIG. 1 is a top plan view of a wingsail rig in accordance with the invention.

Referring to the drawings, the illustrated wingsail rig comprises a leading sail section 10, a trailing sail section 12 and a flap 14. The two sail sections 10 and 12 and the flap 14 are all of aerofoil section, being symmetrical about their vertical center lines. In the drawings the airflow is illustrated going from left to right.

Figure 3:
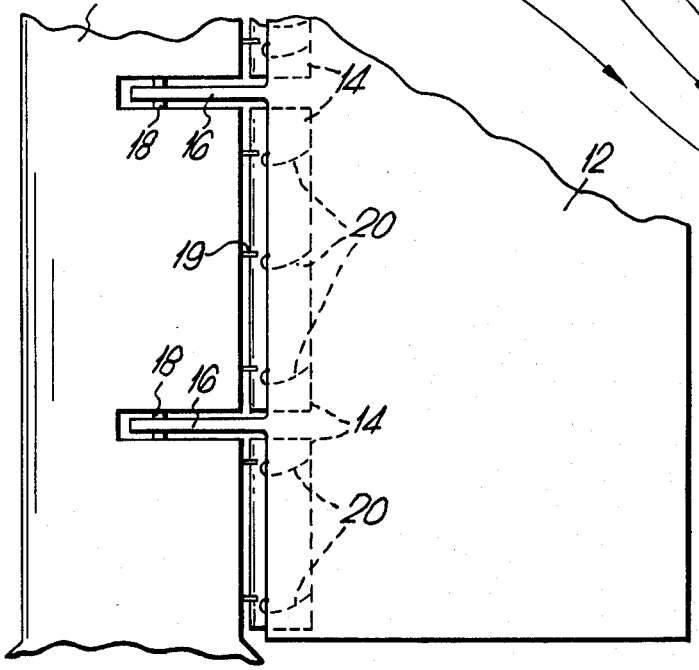
FIG. 3 is a partial elevational view of the rig of FIGS. 1 and 2.

In the illustrated embodiment the leading sail section 10 is mounted to the boat for pivoting about axis 11. The center of the leading edge of the trailing sail section 12 is hinged by a pair of arms 16 to the center line of the leading sail section 10 on axis 18 so that the trailing sail section 12 is freely pivotable with respect to the leading sail section 10 with the leading edge of the trailing sail section just clearing the trailing edge of the leading sail section. As shown in FIG. 3, the arms 16 are set in from the ends of the span to reduce span bending moments in both the leading and trailing sail sections.

The flap 14, which is of small chord symmetrical section, is hinged on its center line to the trailing edge of the leading sail section 10 about axis 19. Because of the set in location of arms 16 the flap 14 comprises three separate flap sections suitably located so that pivoting movement of the flap sections is not hindered by the arms 16.

Figure 2:
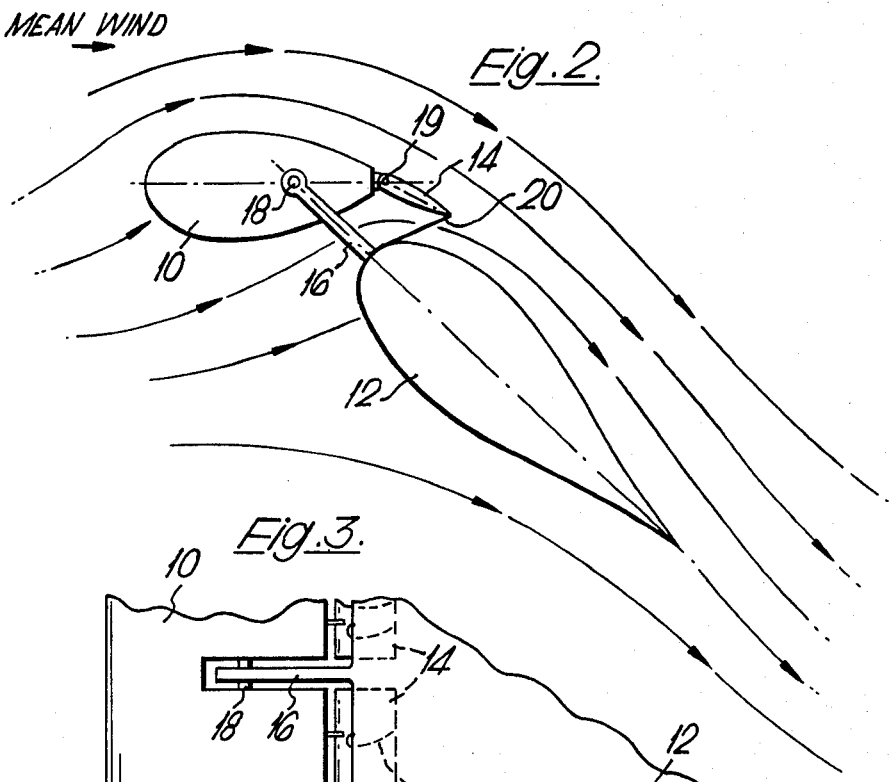
FIG. 2 is a view of the rig shown in FIG. 1 with the sail set so as to effect forward thrust with wind from the port side.

The center line of the trailing edge of the flap sections 14 is joined to the center line of the leading edge of the trailing sail section 12 by multiple flexible lanyards 20. The length of the lanyards (which may be adjustable but in the present embodiment is a fixed length) is such that, when the trailing sail section 12 is rotated about axis 18 to the position of maximum section camber, approximately as illustrated in FIG. 2, the flap 14 is constrained so that its leeward surface lies as a more or less smooth extension of the leeward surface of leading sail section 10. Elastomeric sealing strips 13 may be provided to seal the gap between section 10 and flap 14. The space between flap 14 and trailing sail section 12 now forms a convergent linear nozzle. This nozzle directs air over the leeward surface of the trailing sail section 12 so as to energize the local flow, prolong the extent of attachment of flow, and thus enable high thrust coefficients to be reached at good ratios of thrust to drag.

Figure 4:
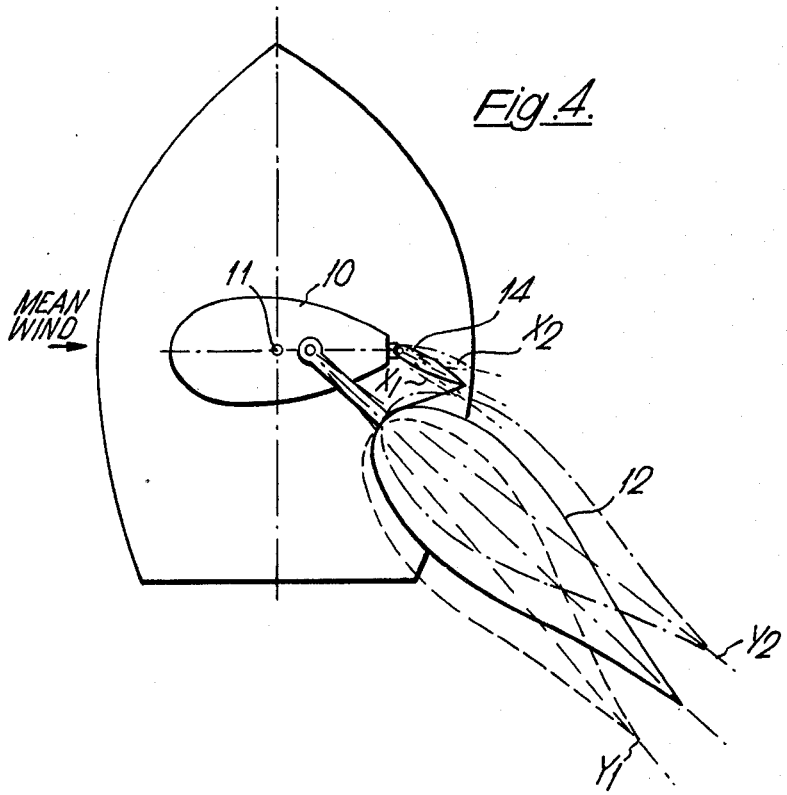
FIG. 4 is a plan view from above of the rig of FIGS. 1, 2 and 3 in different camber settings.

It will be appreciated from FIG. 4 that, since the flap 14 is freely pivoted to the leading sail section 10 and lanyards 20 are of fixed length, the angle of the center line of the flap 14 to the center line of section 10 is a function of the angle of trailing sail section 12 to the center line of section 10, provided there is enough wind to pull the lanyards 20 taut. Thus, movement of trailing sail section 12 clockwise to an extreme angle as at $Y_1$, suitable for, say, downwind work, will pull the flap 14 to a position rather as at $X_1$, while reducing the angle of section 12 to a position suitable for windward sailing, $Y_2$, will allow the flap to go to $X_2$, slightly "reflexed" but still providing a suitable slot conformation.

Figure 5:
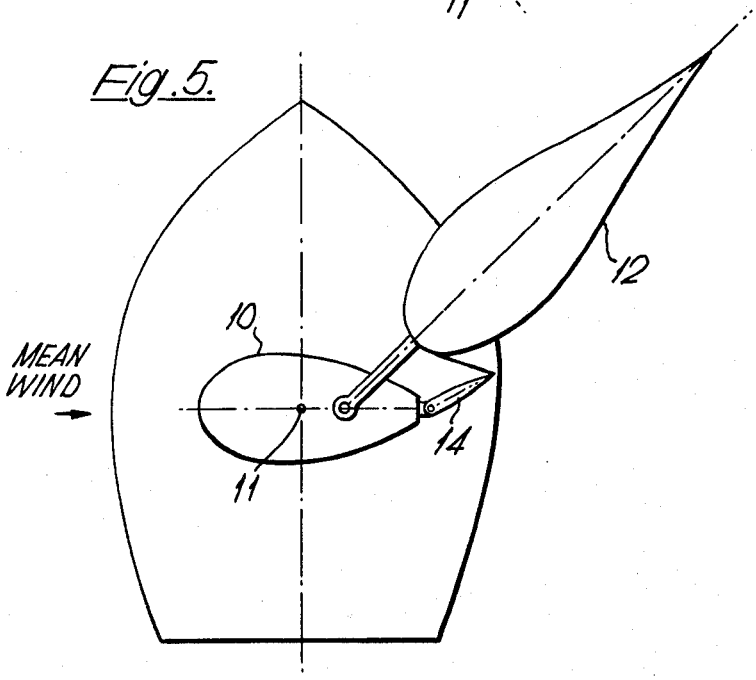
FIG. 5 is a similar top plan view of the rig of FIGS. 1, 2 and 3 illustrating the condition just after the passing through point of the flap.

FIG. 5 shows the same sail set on the same boat in the same wind as FIG. 4, but mirror-imaged to provide reverse thrust or thrust on the opposite tack.

Figure 6:
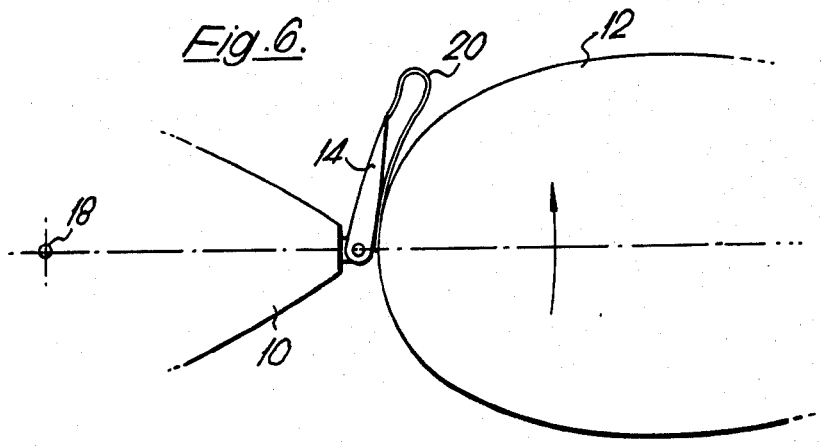
FIG. 6 illustrates the position of the flap when the leading and trailing section sections' center lines are in alignment.
Figure 7:
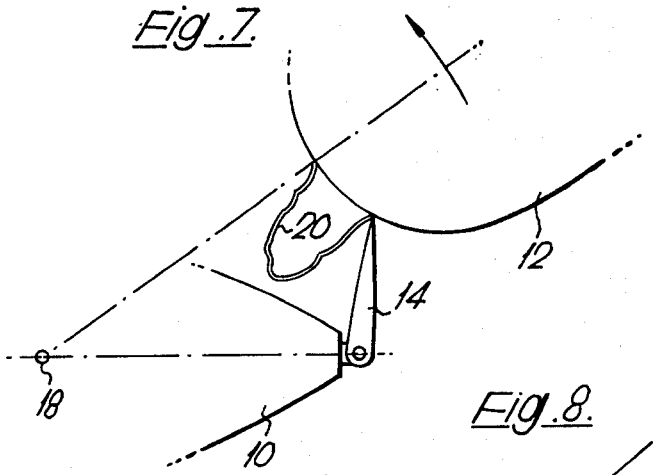
FIG. 7 illustrates in more detail the position of the flap and sail sections just before passing through of the flap.
Figure 8:
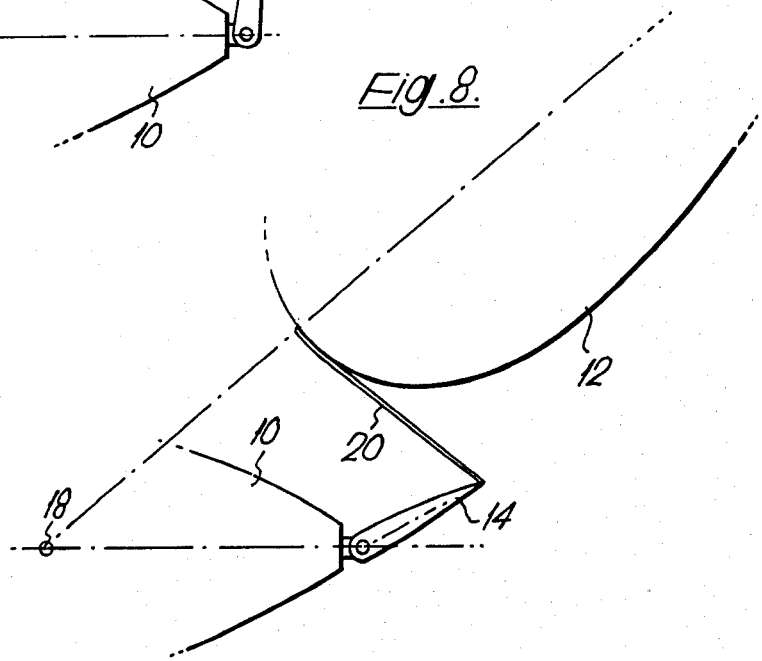
FIG. 8 is similar to FIG. 7 but shows the condition of the flap and sail sections just after passing through of the flap.

FIGS. 6 to 8 indicate the principle which allows this reversal.

FIG. 6 shows the trailing sail section 12, having started from the position shown in FIG. 4, rotated counter-clockwise to the sail set center line. Flap 14 has turned freely in the same sense, and the lanyards 20 have gone slack. FIG. 7 shows trailing sail section 12 further turned to nearly its operating deflection range counter-clockwise in the Figure. The wind is now blowing flap 14 against section 12. The chord of flap 14 is arranged so that the arc of movement of its trailing edge just clears the leading edge profile of section 12 at maximum deflection.

FIG. 8 shows trailing sail section 12 further deflected, having released flap 14, which has quickly moved downwind (to the right in the Figure) until restrained by its lanyard 20.

In the present embodiment, in order to obtain the longest chord of flap 14 possible, the passing through point has been set to near maximum deflection of trailing sail section 12. This means that in windward work the trailing sail section must at each tack be deflected to maximum to release the flap, then returned to a deflection more suitable for windward sailing.

The foregoing description is primarily concerned with relatively small rigs with a sail of some 7 to 10 meters tall. The principle of the invention is equally applicable to larger sails, but then some modification may be needed to the flap as it has been referred to provided by the invention. In the smaller sail rigs, the flap position is controlled by flexible lanyards as shown in the drawings. On a larger rig the flaps would be individually power-operated by a servo-mechanism in coordination with operation of the larger sail members, and no lanyards or ropes would be needed. However, the principle and motion would be exactly the same as that described for the smaller sail illustrated in the drawings.

Further, while the invention has been described with the leading sail section as the main sail section to which the flap and the trailing sail section are fixed, the invention is equally well adapted without alteration to a configuration in which the trailing sail section is the main sail section, the leading section complete with flap being pivoted to it.

Also, while the invention has been described with respect to vertical rectangular sail designs, it is equally well adapted without alteration of principle to sails of inclined parallelogram configuration and to sails of tapered or curvilinear outline.

I claim:

1. A wingsail comprising:

two rigid symmetrical aerofoil section sail sections which are mounted one downstream of the other, the trailing sail section being freely pivotally mounted to the center line of the leading sail section, so that its leading edge just clears the trailing edge of the leading sail section;

a hinged symmetrical rigid flap mounted so as to extend downwind from the trailing edge of the leading sail section, the flap being adapted to be moved to one side or the other in response to a swinging movement of the trailing sail section relative to the leading sail section so that the leeward surface of the flap can form a more or less smooth extension of the leeward surface of the leading sail section, a spacing being defined between the flap and the trailing sail section and forming a convergent linear nozzle so as to assist in directing air over the leeward surface of the trailing sail section and energize the local flow, prolong the extent of attachment of flow and enable an optimum thrust coefficient to be reached.

2. A wingsail according to claim 1, further comprising means for attaching the trailing edge of the flap to the leading edge of the trailing sail section.

3. A wingsail according to claim 2, wherein said means for attaching the trailing edge of the flap further comprises means for producing a required angular position of the flap under appropriate wind conditions as the trailing sail section pivots relative to the leading sail section.

4. A wingsail according to claim 1, wherein the sail sections further comprise sail sections of vertical rectangular configuration.

5. A wingsail according to claim 1, further comprising a plurality of elastomeric sealing strips to seal the gap between the leading sail section and the flap.

6. A wingsail according to claim 1, further comprising a plurality of arms for pivotally mounting the trailing sail section to the leading sail section wherein said arms are set in from ends of the leading sail section span, and wherein the flap further comprises a plurality of separate flap sections so located that pivoting movement of the flap sections is not hindered by the arms.

* * * * *